United States Patent [19]

Dammann et al.

[11] 4,414,803

[45] * Nov. 15, 1983

[54] FALSE TWISTING APPARATUS

[75] Inventors: Peter Dammann; Heinz Schippers; Karl Bauer, all of Remscheid-Lennep, Fed. Rep. of Germany

[73] Assignee: Barmag Barmer Maschinenfabrik AG, Remscheid, Fed. Rep. of Germany

[ * ] Notice: The portion of the term of this patent subsequent to Jul. 20, 1999 has been disclaimed.

[21] Appl. No.: 273,078

[22] Filed: Jun. 12, 1981

Related U.S. Application Data

[63] Continuation-in-part of Ser. No. 168,734, Jul. 14, 1980, Pat. No. 4,339,915.

[30] Foreign Application Priority Data

Jul. 14, 1979 [DE] Fed. Rep. of Germany ..... 2928522
Jul. 9, 1980 [DE] Fed. Rep. of Germany ..... 3025912

[51] Int. Cl.[3] ..... D02G 1/08
[52] U.S. Cl. ..... 57/340; 57/348
[58] Field of Search ..... 57/334–340, 57/348, 349

[56] References Cited

U.S. PATENT DOCUMENTS

| | | | |
|---|---|---|---|
| 2,863,280 | 12/1958 | Ubbelohde | 57/336 X |
| 3,156,084 | 11/1964 | Van Dijk et al. | 57/340 |
| 3,225,533 | 12/1965 | Henshaw | 57/340 X |
| 3,373,554 | 3/1968 | Raschle | 57/340 |
| 3,394,540 | 7/1968 | Bentov | 57/337 X |
| 3,488,941 | 1/1970 | Asaka | 57/340 X |
| 3,495,391 | 2/1970 | Njo | 57/340 |
| 4,050,229 | 9/1977 | Hayahusa | 57/340 X |
| 4,145,871 | 3/1979 | Iwata et al. | 57/340 |
| 4,149,366 | 4/1979 | Bass et al. | 57/339 X |
| 4,339,915 | 7/1982 | Dammann et al. | 57/339 |

FOREIGN PATENT DOCUMENTS

| | | |
|---|---|---|
| 2001120 | 7/1971 | Fed. Rep. of Germany . |
| 2121917 | 8/1971 | France . |
| 1375380 | 11/1974 | United Kingdom . |
| 14121662 | 1/1976 | United Kingdom . |

*Primary Examiner*—John Petrakes
*Attorney, Agent, or Firm*—Bell, Seltzer, Park & Gibson

[57] ABSTRACT

A yarn false twisting apparatus is disclosed which includes a pair of twist imparting discs, with the discs being mounted for rotation so that portions of the disc surfaces are disposed in opposing, substantially non-contacting relationship and define a twisting zone therebetween. The discs rotate in a common rotational direction, and a yarn is continuously advanced through the twisting zone in a direction parallel to a line extending perpendicularly between the axes of rotation of the two discs. In one embodiment, one of the discs is relatively thin and flexible, and there is further provided a pressure applying member which acts to locally bias the flexible disc toward the other disc at the twisting zone. Preferably, the two discs are mounted for movement toward and away from each other in a direction parallel to a line extending perpendicularly between the axes of rotation, and the pressure applying member is mounted for movement in a direction perpendicular to the direction of relative movement between the two discs, to thereby permit the ratio of twist insertion to yarn speed to be adjusted.

8 Claims, 2 Drawing Figures

FALSE TWISTING APPARATUS

Figure 1:
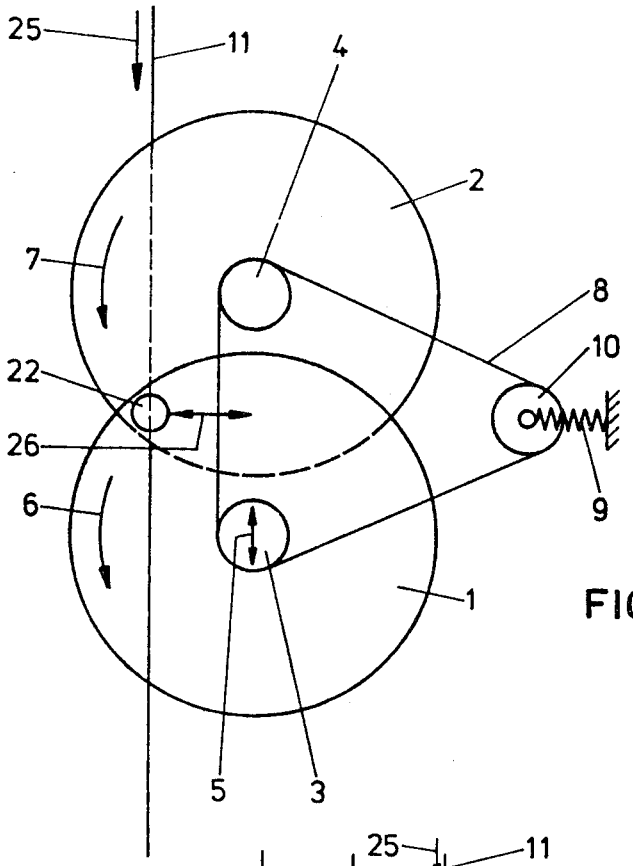

The present application is a continuation-in-part of copending application Ser. No. 168,734, filed July 14, 1980, now U.S. Pat. No. 4,339,915.

Yarn false twisting apparatus for the false twist texturing of synthetic filaments are known, and which consists of two circular discs which are rotated in opposite directions. Typically, the axes of rotation are inclined toward each other and the peripheral edges of the discs contact each other at the twisting zone. In one apparatus of this type, note German Publication (AS) No. 1,192,779, and U.S. Pat. No. 4,145,871, the rotary discs are movable in the axial direction toward and away from each other and the discs are mechanically pressed against each other by spring pressure. The yarn is advanced along a path of travel which extends in a direction essentially perpendicular to the common plane of the two axes of rotation.

It is an object of the present invention to provide a yarn false twisting apparatus of the described type, which is of simplified construction and easy to operate. This object is achieved in the illustrated embodiment of the present invention in that the yarn path of travel is essentially parallel to the common plane of the two axes of rotation of the discs. The discs are rotated in a common rotational direction. In this regard, it will be understood that the axes of rotation may be slightly inclined toward each other by a few degrees, and the term "common plane" is intended to encompass such structure. However, it is preferred that the axes are aligned parallel to each other. Further, it is preferred that at least one of the discs be flexible or pliable, and that a pressure applying member be provided for locally biasing the one flexible disc toward the other disc only at the twisting zone.

The present invention finds particular utility in the case of a yarn false twist crimping machine having a number of false twisting stations positioned in side-by-side relation along the length of its frame. In such case, two parallel shafts are rotatably mounted along the front of the machine, and a pair of twist imparting discs are mounted to the shafts at each of the twisting stations. The thread is advanced through the discs in a direction lying parallel to a line extending perpendicularly between the two shafts. By this arrangement, a very simple construction for the drive of the friction false twisting apparatus is provided, as well as a simplified operation of the individual friction false twist stations, by being able to place the yarn between the discs from the front of the machine and without threading the same between the shafts.

While the present invention is suitable for use with a yarn false twisting apparatus consisting of rigid discs, it is preferable to make one of the discs of a soft, but tension resistant material, and to nip the yarn between the two discs by the action of a pressure applying member which is positioned to locally bias the flexible disc toward the other disc only at the twisting zone. Further, it is preferred to mount the friction discs so as to permit selective relative movement thereof along a direction generally perpendicular to their axes of rotation and parallel to the plane defined by such axes of rotation. Such adjustability permits the ratio of twist insertion and yarn advance speed of the friction false twist apparatus to be varied. Further, in order to accommodate such movement of the friction discs, it is also preferred to mount the pressure applying member for movement in a direction perpendicular to the movement of the discs.

Figure 2:
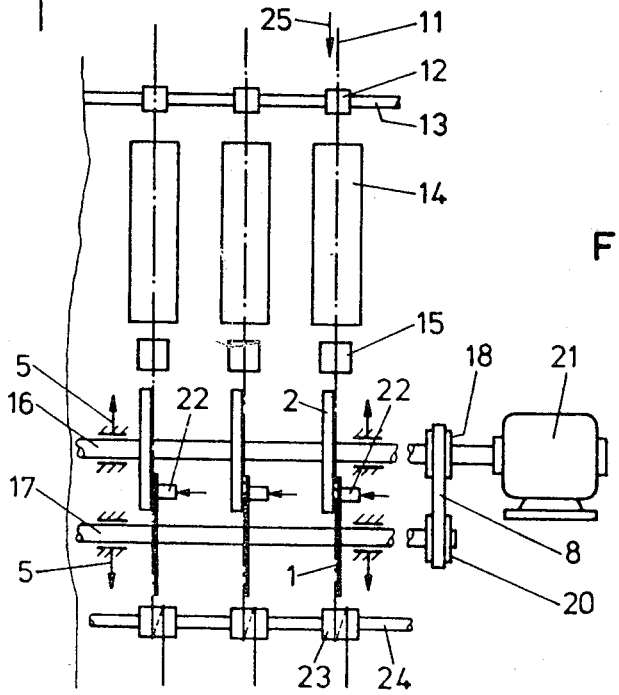

Some of the objects and advantages of the invention having been stated, others will appear as the description proceeds, when taken in connection with the accompanying drawings, in which FIG. 1 is a schematic side elevation view of the discs of a yarn false twisting apparatus embodying the features of the present invention; and FIG. 2 is a schematic front elevation view of a false twist machine having a number of false twisting stations which embody the present invention positioned in a side-by-side relation along the length of its frame.

Referring more specifically to the drawings, FIG. 1 schematically illustrates a friction yarn false twisting apparatus which comprises a pair of twist imparting discs 1 and 2, which rotate about axes 3 and 4 in the same direction 6 and 7. The corresponding drive, which is further illustrated in FIG. 2, consists of a belt 8 which is tensioned by a pulley 10 which is adapted to be moved in the tensioning direction by spring 9. The discs each have a yarn engaging friction surface on one face thereof, and they are mounted such that portions of the respective yarn engaging friction surfaces are disposed in opposing, substantially non-contacting relationship and define a twisting zone therebetween. A yarn 11 is guided between the discs and through the twisting zone, and in a direction parallel to a line extending perpendicularly between the axes of rotation of the discs 1 and 2. By this arrangement, a twist is imparted to the advancing yarn by the frictional contact between the yarn and the respective opposed friction surfaces.

The axes of rotation 3 and 4 may be parallel to each other, or slightly inclined toward each other so that the front faces of the discs are at their shortest distance from each other in the area of the twisting zone, without touching each other at any other point. Disc 1 is preferably flexible, which may be achieved by fabricating the disc of a relatively thin pliable material which may be deflected from its normal plane relative to its axis of rotation by a pressure applying member 22. Specifically, the disc 1 may be composed of a sheet of rubber or similar material, and have similar physical properties as transmission belts or air tubes in vehicle tires. Also, the disc 1 may consist of a flexible material, such as a thin steel plate, having a suitable friction coating in the area where yarn is nipped. In either case, the pressure applying member 22 upsets or deflects the disc 1 only at the twisting zone, and so that the yarn is nipped and false twisted between the opposing faces of the discs 1 and 2.

FIG. 2 schematically illustrates a yarn false twisting machine having a plurality of false twisting stations positioned in side-by-side relation along the length of the frame. A yarn 11 is fed through each of the false twisting stations, and is guided in direction 25 over feed roll 12. The feed rolls 12 are arranged on a common shaft 13. The yarn then travels through a heater 14, and cooling system 15, and enters the friction false twist apparatus of the present invention. Delivery rolls 23 withdraw the yarn from the friction false twist apparatus, and in this regard, it should be noted that the false twist apparatus not only imparts twist to the yarn, but also conveys the yarn in the direction 25. The delivery rolls are also arranged on a common shaft 24.

The friction discs 1 of all of the false twisting stations are arranged on a common shaft 17, which extends horizontally along the length of the machine frame. Friction discs 2 are mounted on a second shaft 16, which is disposed parallel to and above the shaft 17. The discs 1 and 2 are arranged on their respective shafts 17 and 16 so that they are disposed in pairs as described above with respect to FIG. 1. Each false twisting station is also provided with a pressure applying member 22, which presses against the back side of the flexible disc 1. The shafts 16 and 17 are driven by a motor 21, which is drivingly connected through belt pulleys 18 and 20 and belt 8. A tension pulley 10, as illustrated in FIG. 1, may also be provided for the machine of FIG. 2.

At least one of the shafts 16 or 17 may be mounted to the frame by means permitting selective relative movement along a direction indicated by the arrow 5, which is parallel to a line extending perpendicularly between the shafts 16 and 17. In such case, the pulley 10 insures that the belt 8 remains properly tensioned. By changing the distance between the shafts, the ratio of twist insertion and yarn advance of the friction false twist apparatus can be varied. In addition, the pressure applying mechanism may be mounted for movement in the direction of arrow 26 as shown in FIG. 1, so as to adapt the member to the changed distance between the shafts 16 and 17.

A particular advantage of the friction false twist apparatus and its arrangement shown in FIG. 2 resides in the fact that the friction false twist apparatus is simple in construction and therefore economical in design, to thus provide substantial operational advantages. Further, since the yarn is guided along the front side of the shafts, i.e., on the side of the shafts opposite the frame, the yarn may be placed into the friction false twist apparatus from the front or operational side of the machine, which facilitates the thread-up of the yarns on the machine, and permits the yarns to be observed during operation of the machine. Also, the yarn need not be threaded between the two shafts 16 and 17.

In the drawings and specification, there has been set forth a preferred embodiment of the invention and although specific terms are employed, they are used in a generic and descriptive sense only and not for purposes of limitation.

That which is claimed is:

1. A yarn false twisting apparatus characterized by the ability to adjust the ratio of twist to yarn advance speed, and comprising a frame, a pair of twist imparting discs, with each disc having a yarn engaging friction surface on one face thereof, means mounting said discs to said frame for rotation about essentially parallel, spaced apart axes and such that portions of the respective yarn engaging friction surfaces are disposed in opposing, substantially non-contacting relationship and define a twisting zone therebetween, and including means permitting selective relative movement of said discs along a direction generally perpendicular to their axes of rotation and parallel to the plane defined by such axes of rotation, and drive means for rotating each of said discs in a common rotational direction and such that their respective yarn engaging friction surfaces run in different directions through said twisting zones, whereby a yarn may be continuously moved through said twisting zone in a direction parallel to and laterally spaced from a line extending perpendicularly between said axes of rotation and so as to have twist imparted thereto by frictional contact between the yarn and the respective opposed friction surfaces.

2. The yarn false twisting apparatus as defined in claim 1 wherein at least one of said discs is relatively thin and flexible, and said apparatus further comprises a pressure applying member, and means mounting said pressure applying member to said frame so as to locally bias said one flexible disc toward the other disc only at said twisting zone.

3. The yarn false twisting apparatus as defined in claim 2 wherein said means mounting said pressure applying member to said frame includes means mounting the same for selective movement along a path of travel which extends perpendicular to said plane defined by the axes of rotation of said discs.

4. A yarn false twisting machine having a frame, a plurality of false twisting stations positioned in side-by-side relation along the length of said frame, and means for feeding a yarn through each of the false twisting stations, the improvement wherein said machine includes a pair of parallel, spaced apart shafts rotatably mounted to said frame and extending horizontally therealong, a pair of twist imparting discs mounted to respective ones of said shafts at each of said twisting stations, with the discs of each pair having a yarn engaging friction surface on one face thereof, and such that portions of the respective yarn engaging friction surfaces of each pair are disposed in opposing relationship and define a twisting zone therebetween, means for rotating said shafts and each of said pairs of discs in a common rotational direction, means for guiding the advancing yarn through said twisting zone of each of said pairs of discs and in a direction parallel to a line extending perpendicularly between said shafts, whereby each yarn may be continuously advanced through a twisting zone while having twist imparted thereto by frictional contact between the yarn and the respective opposed friction surfaces.

5. The yarn false twisting machine as defined in claim 4 wherein said shafts are mounted to said frame by means permitting selective relative movement along a direction parallel to a line extending perpendicularly between said shafts.

6. The yarn false twisting machine as defined in either claim 4 or 5 wherein at least one disc of each pair is relatively thin and flexible, and further comprising a pressure applying member operatively associated with each pair of discs and so as to locally bias said one flexible disc toward the other disc only at said twisting zone.

7. The yarn false twisting machine as defined in claim 6 wherein each of said pressure applying members is mounted by means permitting selective movement along a direction which is perpendicular to a line extending perpendicularly between said shafts.

8. The yarn false twisting machine as defined in claim 4 or 5 wherein said shafts are positioned along the front side of said frame, and said yarn guiding means are positioned to guide the advancing yarns on the side of said shafts opposite said frame, to thereby facilitate the thread-up of the yarns on the machine.

* * * * *